US006520262B2

(12) United States Patent
Barnett et al.

(10) Patent No.: US 6,520,262 B2
(45) Date of Patent: Feb. 18, 2003

(54) RISER CONNECTOR FOR A WELLHEAD ASSEMBLY AND METHOD FOR CONDUCTING OFFSHORE WELL OPERATIONS USING THE SAME

(75) Inventors: Richard C. Barnett, Cypress, TX (US); Johnnie Kotrla, Katy, TX (US); William M. Taylor, Houston, TX (US)

(73) Assignee: Cooper Cameron Corporation, Houston, TX (US)

( * ) Notice: Subject to any disclaimer, the term of this patent is extended or adjusted under 35 U.S.C. 154(b) by 0 days.

(21) Appl. No.: 09/770,554

(22) Filed: Jan. 26, 2001

(65) Prior Publication Data

US 2002/0100591 A1 Aug. 1, 2002

(51) Int. Cl.[7] ..... E21B 17/01; E21B 29/12

(52) U.S. Cl. ..... 166/367; 166/339; 166/359; 166/345; 405/224.4; 405/224.2

(58) Field of Search ..... 166/339, 345, 166/70, 355, 360, 359, 367; 405/224.2, 224.3, 224.4, 223.1

(56) References Cited

U.S. PATENT DOCUMENTS

| | | | | | |
|---|---|---|---|---|---|
| 1,791,874 | A | * | 2/1931 | Rodgers | 166/64 |
| 2,140,128 | A | | 12/1938 | Craggs | 302/28 |
| 2,586,144 | A | | 2/1952 | Benoit | 302/28 |
| 3,139,932 | A | | 7/1964 | Johnson | 166/95 |
| 3,384,421 | A | * | 5/1968 | Flatt | 137/625.44 |
| 3,472,317 | A | * | 10/1969 | Fowler | 137/875 |
| 3,545,489 | A | * | 12/1970 | Brown | 137/876 |
| 3,612,177 | A | * | 10/1971 | Gassett et al. | 114/265 |
| 3,758,072 | A | * | 9/1973 | Herd | 137/333 |
| 3,834,418 | A | | 9/1974 | Clancy | 137/625.48 |
| 3,866,628 | A | * | 2/1975 | Weber et al. | 137/625.44 |
| 3,881,516 | A | * | 5/1975 | Childers et al. | 137/625.44 |
| 4,062,551 | A | * | 12/1977 | Base | 166/242.5 |
| 4,147,221 | A | | 4/1979 | Ilfrey et al. | 175/7 |
| 4,224,986 | A | * | 9/1980 | Rothberg | 166/117.5 |

(List continued on next page.)

FOREIGN PATENT DOCUMENTS

| | | | |
|---|---|---|---|
| WO | WO00/34618 | 6/2000 | E21B/19/00 |
| WO | WO00/34619 | 6/2000 | E21B/19/00 |

*Primary Examiner*—Robert E. Pezzuto
*Assistant Examiner*—Thomas A. Beach
(74) *Attorney, Agent, or Firm*—Michael P. Hartmann; Peter A. Bielinski

(57) ABSTRACT

A riser connector is provided for connecting a riser to a wellhead assembly having a bore therethrough. The connector includes a housing having a first and a second end. The first end of the housing has an opening and is adapted for mounting to the wellhead assembly with the opening in communication with the bore of the wellhead assembly. The second end has a first opening connectable to the riser having a diameter at least the same as the inner diameter of the riser, and a second opening, having a diameter at least substantially the same as the diameter of the bore of the wellhead assembly. The housing further includes a first conduit connecting the opening in the first end of the housing to the first opening in the second end of the housing, and a second conduit connecting the opening in the first end of the housing to the second opening in the second end of the housing. In use, first well operations are conducted through the riser in the conventional manner. Second well operations are conducted using open water techniques and access the wellhead assembly and the well through the second conduit in the connector without the need to disconnect the riser from the connector. The riser connector is of particular use with risers having an inner diameter less than the diameter of the bore of the wellhead assembly, the second well operations being conducted using equipment which is too large to pass through the small bore riser.

22 Claims, 9 Drawing Sheets

U.S. PATENT DOCUMENTS 4,252,149 A * 2/1981 Dollison ..... 137/385
4,397,357 A * 8/1983 Hettinger ..... 166/345
4,399,877 A * 8/1983 Jackson et al. ..... 166/65.1
4,437,521 A 3/1984 Richardson et al. ..... 166/341
4,489,780 A * 12/1984 Duhon ..... 137/875
4,506,729 A * 3/1985 Davis et al. ..... 166/242.5
4,681,162 A * 7/1987 Boyd ..... 166/242.5
5,284,210 A * 2/1994 Helms et al. ..... 166/117.5
5,435,395 A * 7/1995 Connell ..... 166/384
6,269,879 B1 * 8/2001 Boyd ..... 166/242.5
6,352,114 B1 * 3/2002 Toalson et al. ..... 166/339

* cited by examiner

RISER CONNECTOR FOR A WELLHEAD ASSEMBLY AND METHOD FOR CONDUCTING OFFSHORE WELL OPERATIONS USING THE SAME

TECHNICAL FIELD OF THE INVENTION

The present invention relates to a riser connector for use in offshore well operations. In particular, the present invention relates to a riser connector for connecting a riser system to a subsea wellhead assembly. In addition, the present invention relates to a method of conducting offshore well operations using the riser connector.

BACKGROUND OF THE INVENTION

Offshore operations for the exploration and production of hydrocarbons involve the use of a wellhead assembly situated on the floor of the ocean and a platform from which the operations are conducted. In the case of hydrocarbon deposits situated beneath shallow water, it is common practice to provide stationary platforms secured to the ocean floor. However, in deeper water, the use of stationary platforms becomes impractical and floating platforms are required. In use, floating platforms are connected to the blowout preventer and wellhead assemblies situated on the ocean floor by means of risers.

Currently, offshore operations are being required to be conducted in ever deeper water, necessitating the need for longer riser assemblies to connect the floating platform or vessel to the wellhead assembly on the ocean floor. However, increasing the length of the drilling riser connecting a floating platform or vessel to the assemblies on the ocean floor gives rise to a number of major problems. First, the overall weight of the riser assembly increases as the length of the riser increases. In addition, the weight of the drilling fluids or "mud" contained in the riser also increases as the length of the riser increases. Further, in operation, tensioning force applied by the floating platform must be maintained on the riser in order to prevent the riser from buckling. Again, the task of keeping the necessary tension on the drilling riser assembly becomes increasingly problematic as the length, and hence the weight, of the riser increases. As a result of these problems, many existing floating platforms and vessels have a maximum working depth of water in which they can safely perform downhole operations. Typically, many of these platforms and vessels are limited to operating in water up to depths of about 5000 feet. The need to operate in deeper water, for example in depths up to 10,000 feet or greater, necessitates the construction of new, larger floating platforms and vessels capable of carrying out well operations accommodating the even greater weight of risers required to operate at such depths.

As a solution to the aforementioned problems, it has been proposed to employ risers of smaller diameter than conventionally employed. Typically, offshore operations have used risers having an outer diameter of 21 inches and a nominal inner diameter of 19 inches. The proposal has been made to convert operations to a small bore riser, typically having an outer diameter of 16 inches and a nominal inner diameter of 13.5 inches. It will be readily appreciated that the reduction in diameter of the riser from 21 inches to 16 inches will result in a significant reduction in the weight of the riser assembly. The volume of a riser increases with the square of any increase in the diameter of the riser. In addition, therefore, it will also be appreciated that the weight of fluid to be retained and supported by the riser will also be significantly reduced by converting operations to a smaller diameter riser. The use of the smaller bore risers reduce the overall weight of the riser assembly, leading to savings in the loading placed on the floating platforms and vessels, reducing storage requirements, and reducing the effort required to tension the riser when in use. In principle, therefore, the use of a small bore riser would increase the working depth of many existing vessels and platforms, allowing them to operate in significantly greater depths than have been possible employing the conventional 21 inch riser.

In practice, however, converting operations to using small bore risers produces a umber of practical problems, which need to be overcome before the use of small bore risers can become feasible. The blowout preventer (BOP) stack present on the top of most undersea wellhead assemblies has a nominal internal diameter of 18.75 inches. This has become a conventional size in the design of BOP stacks, able to accommodate all the tools and equipment necessary to be passed through the wellhead assembly during subsea drilling operations. Thus, conventional BOP stacks in combination with standard 21 inch diameter risers allow the use of conventional tools, such as drill bits, cementing tools and the like. In addition, this combination accommodates the installation of standard 16 inch casings and casing hangers used in the construction of the upper portion of a well. In contrast, the small bore risers mentioned before, having an internal diameter of just 13.5 inches, will not accommodate much of the aforementioned equipment. In particular, standard drilling and cementing tools will not pass through a small bore riser. Further, it is not possible to install a 16 inch casing and its associated hangers through a small bore riser.

One solution to this problem would be to reduce the size of the wellhead assembly, including the BOP stack, and the equipment used in downhole operations. However, in addition to requiring the replacement of much of the existing equipment on platforms and vessels currently in use, this reduction in size would ultimately limit the eventual completion size of the well and its eventual production capacity. Accordingly, there is a need for a system which solves the problem of the excessive weight of the risers arising out of deep water operation, but which still allows the use of conventional downhole equipment.

One solution to this problem that has been proposed involves the use of a small bore riser, which is disconnected from the wellhead assembly at an appropriate time in order to allow for the passage of equipment of standard size. Thus, U.S. Pat. No. 4,147,221 discloses a marine riser system for use in deep water drilling operations from a floating vessel, which allows the lower end of the riser to be detached from the wellhead. The lower end of the riser is set aside to a position clear of the wellhead. A support is provided to retain the riser in the set aside position. With the riser in the set aside position, casings and tools having diameters greater than that of the riser internal diameter can then be passed into the BOP and the wellhead assembly and inserted into the well. The system of U.S. Pat No. 4,147,221 allows the use of a small bore riser, while retaining the possibility of using larger diameter equipment without the need of returning the small bore riser to the surface. However, the system of U.S. Pat. No. 4,147,221 requires the presence of support mechanisms and guidance systems in order to move the riser from the wellhead to the set aside position. In addition, means and methods must be provided in order to adjust the rig-applied tension during the riser's movement between the wellhead and the set aside support position.

An alternative design of set aside system is disclosed in International patent publication number WO 00/34618. The system uses a reduced diameter drilling riser, in turn reducing the size and cost of the attendant floating platform or vessel. The system has means for disconnecting the riser from the BOP stack on the wellhead assembly and repositioning it in a set aside position. The system comprises a mud return assembly to which the riser is connected in the set aside position. Larger diameter tools and casings can be passed through the BOP and wellhead into the well and downhole operations conducted with drilling fluids being returned through the mud return assembly and the reduced diameter riser. The riser may be returned to the BOP and wellhead assembly and normal operations resumed, once the operations requiring the larger diameter equipment have been completed. While the system of WO 00/34618 allows the riser to be used as the return path for the drilling fluids when in the set aside position, it still requires the riser to be disconnected from the BOP and wellhead assembly and moved aside. Again, the system requires means for guiding and tensioning adjustment of the riser assembly, while it is being moved between the set aside position and the wellhead.

U.S. Pat. No. 6,367,554 B1 discloses a further improved system for employing a small bore riser. The riser may be disconnected from the wellhead assembly when it is required to gain access to the BOP and wellhead assembly and into the well with larger diameter equipment and tools. The system includes a stress member to which the riser is mounted. The stress member is flexible and is deflected by a shifter to move the riser out of connection with the BOP and wellhead assembly. The stress member acts as a conduit to allow a hydrostatic head to be maintained to control the welt In a preferred embodiment, the stress member includes choke and kill lines which remain in connection throughout the operation. In this way, the small bore riser may be moved aside with the minimum of disruption to the operation of the well with no actual structural disconnect involved.

U.S. Pat. No. 3,139,932 discloses a wellhead with a tool diverter for use in so-called "through-the-flow-line" well maintenance techniques. The wellhead is in the form of a Y-shaped tube assembly and comprises a diverter to allow tools introduced through the line to be selectively passed along one branch of the Y-shaped tube. In this way circulating objects pumped through the tubing string may be selectively diverted and discharged through the appropriate orifice of the wellhead. U.S. Pat. No. 3,139,932 is silent about offshore downhole operations employing risers, in particular small bore risers, and the use of larger diameter equipment and tools.

It will be appreciated that, while the set aside systems proposed in the prior art offer a solution to many of the problems associated with the use of small bore risers, it is by no means a simple operation to disconnect the small bore riser from the wellhead and move it aside, in order to gain access to the BOP and wellhead assembly with equipment and tools of larger diameter than can be accommodated by the smaller riser. The riser must be maintained under tension during the entire set aside operation. In addition, it is necessary to provide support and power to the mechanism used to move the riser during the set aside operation. Further, flexible hoses and pipes must be employed in order to maintain the service lines, including choke and kill lines, in operation during the set aside. These requirements add to the size and complexity of the apparatus required to carry out these procedures. Accordingly, there is a need for an improved system allowing for the use of small bore risers, while permitting larger diameter equipment, in particular casings and casing hangers, which cannot be accommodated by the small bore riser to be installed with a minimum of disruption to normal operations.

SUMMARY OF THE INVENTION

There has now been found a connector assembly for connecting a riser to a wellhead assembly, which allows a riser to be connected to the subsurface wellhead and allow normal well operations to be carried out using the riser, while at the same time allowing access to the wellhead assembly for other tools and equipment using open water techniques, without requiring the riser to be disconnected from the wellhead assembly. The riser connector is particularly useful for connecting a small bore riser to a subsurface wellhead assembly allowing well operations to be carried out using the small bore riser, while also allowing access to the wellhead assembly for larger diameter tools and equipment not able to be accommodated by the small bore riser without requiring the riser to be disconnected from the wellhead assembly or set aside.

According to the present invention, there is provided in a first aspect a riser connector for connecting a riser to a wellhead assembly having a bore therethrough, the connector comprising: a housing having a first and a second end; the first end of the housing having an opening of a diameter at least substantially the same as the inner diameter of the bore of the wellhead assembly and being adapted for connecting to the wellhead assembly with the opening in communication with the bore of the wellhead assembly; the second end comprising a first opening connectable to the riser and having a diameter at least substantially the same as the inner diameter of the riser, and a second opening, having a diameter at least substantially the same as the diameter of the bore of the wellhead assembly; the housing further comprising a first conduit connecting the opening in the first end of the housing to the first opening in the second end of the housing, and a second conduit connecting the opening in the first end of the housing to the second opening in the second end of the housing.

The first opening in the second end of the connector preferably has an inner diameter less than the diameter of the bore of the wellhead assembly. In this way, the riser connector allows a small bore riser to be connected to the wellhead by means of the first conduit such that well operations, for example drilling, may be conducted through the riser in the conventional manner. When the need arises to carry out well operations which cannot be accommodated by the small bore riser, the second conduit is available to access the wellhead assembly and the well itself Preferably, the well operations gaining access to the wellhead through the second conduit will be conducted using open water techniques known in the art. If desired, however, a riser of conventional size can be lowered into place and connected to the second opening in the second end of the housing for the duration of the well operations requiring a larger diameter riser assembly.

The first and second conduits may be substantially separate from one another and discrete within the housing. Alternatively, a portion of the first and second conduits may occupy the same volume within the housing. In one embodiment, the housing defines a chamber extending from the first end to the second end. The first and second conduits occupy portions of the chamber.

The riser connector preferably comprises one or more guides, by which tools and equipment being passed through the connector are guided through the opening in the first end of the housing and into the wellhead assembly. Most conveniently, the one or more guides may be formed from a portion of the housing adjacent the first end of the housing.

In one embodiment of the present invention, the first conduit has a central longitudinal axis lying on a substantially straight line extending between the center of the opening in the first end of the housing and the first opening in the second end of the housing. In this way, when the connector is in normal use, tools and equipment may be passed from the riser through the first conduit in the riser connector without substantial deviation. It is preferred that the riser connector is so arranged that, when the connector is mounted on a wellhead assembly and in use, the central longitudinal axis of the first conduit is substantially coaxial with the central longitudinal axis of the central bore of he wellhead assembly. In this way, tools and equipment can pass down the riser, through the connector and into the wellhead without needing to overcome a substantial change in direction.

In this first embodiment of the riser connector, the second conduit may extend from the opening in the first end of the housing to the second opening in the second end with its central longitudinal axis forming a substantially straight line between the center of the opening in the first end of the housing and the center of the second opening in the second end of the housing. In this arrangement, the longitudinal axis of the second conduit is angled to the longitudinal axis of the first conduit. The riser connector may be sufficiently long that the angle between the longitudinal axes of the first conduit and the second conduit is sufficiently small that, in use, tools and equipment introduced into the wellhead assembly through the second conduit are subjected to only a minor directional change.

When the connector of this embodiment is in use, advantage may be taken of the flexible joint present in many conventional LMRP's to vary the orientation of the riser connector. While well operations using the riser to gain access to the wellhead assembly through the first conduit are in progress, the riser connector and that portion of the wellhead assembly above the flexible joint can be oriented such that the longitudinal axis of the first conduit is substantially coincident with the central longitudinal axis of the wellhead assembly. When it is required to conduct well operations through the second conduit, the riser connector and the portion of the wellhead assembly above the flexible joint may be moved to allow the longitudinal axis of the second conduit to be substantially coincident with the central longitudinal axis of the wellhead assembly.

Alternatively, the riser connector of the present invention may be prepared from a material flexible enough to allow the connector itself to be oriented to bring the first and second conduits into substantial alignment with the bore of the welfhead assembly as described above. In this way, the riser connector itself provides flexibility between the wellhead and the riser, thus eliminating the need for a flexible joint.

In a second embodiment of the riser connector of the present invention, the second conduit is formed so as to have a curved longitudinal axis. The radius of curvature of the longitudinal axis of the second conduit is selected such that the deviation in direction of tools and equipment passing through the second conduit during well operations can be accommodated. Alternatively, the second conduit may comprise a plurality of straight portions angled such that the second conduit extends from the opening in the first end to the second opening in the second end of the housing. Again, the number and angle of the portions of the second conduit are selected such that the deviation of tools and equipment passing through the second conduit may be accommodated during normal well operations.

In use, the second embodiment of the riser connector may take advantage of the flexible section present in many LMRP's to vary the orientation of the riser connector as described above. Alternatively, the riser connector itself may be formed from a flexible material, enabling the connector to be flexed and vary the orientation of the first and second conduits. In this respect, it is to be understood that references to variations in the orientation of the riser connector include both rotational movement, as well as side-to-side movement of the connector.

In some cases, in particular when using a small bore riser and conducting well operations using larger diameter equipment through the open water, it may be preferred to provide the riser connector with a second conduit that has a longitudinal axis extending in a straight line from the center of the opening in the first end of the connector and the center of the second opening in the second end. The riser connector can thus be oriented above the wellhead assembly such that the longitudinal axis of the second conduit is substantially vertical and coincident with the axis of the bore in the wellhead assembly. The first conduit will then have a straight or curved longitudinal axis angled to the longitudinal axis of the first conduit and the bore of the wellhead assembly. The larger tools and equipment being used during the second well operations are less able to accommodate and negotiate deviations in the passage into the well. With such an arrangement, these larger diameter tools will require little or no deviation when being passed into the well. The first conduit will comprise some minor deviations in the direction of equipment passing through it and the wellhead assembly into the well. However, the smaller diameter tools and equipment being passed through the small bore riser are more able to negotiate deviations in the path through the first conduit of the connector and into the wellhead assembly.

In embodiments of the present invention in which, in use, the orientation of the riser connector is to be varied, the riser connector preferably comprises an actuator to act upon the connector and vary its orientation. In such cases, the connector is preferably biased to the orientation in which the longitudinal axis of the first conduit is aligned with the central longitudinal axis of the wellhead assembly. However, in situations mentioned above in which larger diameter tools and equipment are being passed through the open water into the second conduit, it may be preferably to bias the connector such that the longitudinal axis of the second connector is aligned with the central longitudinal axis of the wellhead assembly.

Preferably, the riser connector of the present invention comprises a valve in the second conduit, by which the second conduit may be closed. Further, a valve may be provided by which the first conduit may be closed. In this way, in use, the riser may be isolated and the drilling fluids present in the riser prevented from escaping during well operations using the second conduit. In a preferred embodiment, a valve is provided, for example a sliding gate valve, by which either one of the first and second conduits or optionally both conduits may be closed. In this way, well operations may be conducted using either conduit to gain access to the wellhead assembly with the option of keeping the other conduit open, for example for the supply of drilling fluids to or from the well.

The riser connector of the present invention may be connected directly to the wellhead assembly. However, the riser connector may be placed at any suitable point between the surface vessel or platform and the subsea wellhead assembly.

In a further aspect, the present invention provides a wellhead assembly, comprising a central bore through the wellhead assembly, and a riser connector, the riser connector comprising: a housing having a first and a second end; the first end of the housing being connected to the wellhead assembly and having an opening in communication with the bore of the wellhead assembly, the opening having a diameter at least substantially the same as the bore of the wellhead assembly; the second end comprising a first opening connectable to a riser and having a diameter at least the same as the inner diameter of the riser, and a second opening, having a diameter at least substantially the same as the diameter of the bore of the wellhead assembly; the housing further comprising a first conduit connecting the opening in the first end of the housing to the first opening in the second end of the housing, and a second conduit connecting the opening in the first end of the housing to the second opening in the second end of the housing.

The wellhead assembly may be of conventional design and may comprise a blowout preventer (BOP) stack, as commonly employed in the art. However, the connector of the present invention is not limited in its use to wellhead assemblies comprising a BOP stack and may be equally well employed in combination with wellhead assemblies without BOP stacks.

The riser connector used in the wellhead assembly may have the features described above. The wellhead assembly may comprise a flexible joint positioned so as to lie between the well and a riser connected to the wellhead assembly during use. As noted above, the riser connector of the present invention may be flexible. Accordingly, the riser connector may act as the flexible joint in the wellhead assembly.

The wellhead assembly is of particular use in conjunction with a small bore riser, which may be connected to the wellhead assembly by means of the riser connector, allowing access from the end of the riser to the well by means of the first conduit in the riser connector.

In a further aspect, the present invention provides a method of conducting well operations on an offshore well having a wellhead assembly, the wellhead assembly having a bore, the method comprising: providing a first conduit having an upper end and a lower end, the lower end being in communication with the bore of the wellhead assembly; connecting a riser to the upper end of the first conduit; providing a second conduit having an upper end and a lower end, the lower end being in communication with the bore of the wellhead assembly, the upper end being accessible through the open water; conducting first well operations accommodated by the inner diameter of the riser through the riser and first conduit; conducting second well operations through the open water and the second conduit.

It is a particular advantage of the method that the riser need not be disconnected from the first conduit while the second downhole operations are performed.

The method may employ a small bore riser connected to the upper end of the first conduit, through which the first well operations are conducted. The method is particularly useful for the installation in the well of apparatus having an outer diameter greater than the inner diameter of the small bore riser. Such apparatus includes casings, drilling tools, completion tools and the like.

It is a further advantage of the method of this invention that the apparatus, such as casings, may be prestaged in the open water alongside the riser, be it of conventional bore or a small bore riser, while the first well operations are in progress. It is a simple operation to interrupt the first well operations to set the apparatus through the second conduit at the appropriate time without disconnecting the riser from the first conduit.

The wellhead assembly may comprise a flexible joint, as discussed above. The upper end of the second conduit may be located above the flexible joint and the tools and equipment, such as casings and casing hangers, introduced into the well through the upper end of the second conduit above the flexible joint.

The second conduit will generally remain closed while the first well operations are performed through the riser and the first conduit. The first conduit may be closed while the second well operations are performed. Alternatively, the first conduit may remain open while the second well operations are performed through the open water and the second conduit. This allows the riser and the first conduit to be of use, for example for the supply or return of muds or other drilling fluids to or from the well.

The riser connector may comprise an additional opening, for example in the housing, which may be adjacent the first or second end of the connector. This additional opening, typically sealed by a valve, will allow the contents of the riser to be evacuated, if this proves necessary.

As noted above, the riser connector and method of the present invention allow open water operations to gain access to the bore of a well through the wellhead assembly above the flexible joint. Accordingly, in a further aspect, the present invention provides a method of running a casing in the bore of an offshore well, the well having a wellhead assembly comprising a flexible joint and connected to the surface by a riser, which casing has an outer diameter greater than the inner diameter of the riser, the method comprising providing the casing through the open-water and accessing the wellhead assembly through an opening located above the flexible joint.

Specific embodiments of the apparatus and method of the present invention will now be described in detail having reference to the accompanying drawings. The detailed description of these embodiments and the referenced drawings are by way of example only and are not intended to limit the scope of the present invention.

BRIEF DESCRIPTION OF THE DRAWINGS

Preferred embodiments of the present invention will now be described, by way of example only, having reference to the accompanying drawings, in which.

DETAILED DESCRIPTION OF THE PREFERRED EMBODIMENTS

The present invention is directed to a riser connector and a method for its use in performing well operations from an offshore platform or vessel through a riser system and through the open water. The connector and method are particularly advantageous in that they allow risers having a small bore to be employed, referred to herein as "small bore risers". Various embodiments of the present invention provide a number of different constructions and methods of operation. It is to be recognized that the different teachings of the embodiments discussed below may be employed separately or in any suitable combination to produce desired results.

Typically, conventional subsea well drilling operations will employ risers having a nominal outside diameter of 21 inches and a nominal inside diameter of 19 inches. Small bore risers are risers having outer and inside diameters less than those of the conventional risers. For example, small bore risers may have a nominal outer diameter of 16 inches and a nominal inner diameter of 14 inches.

Figure 1:
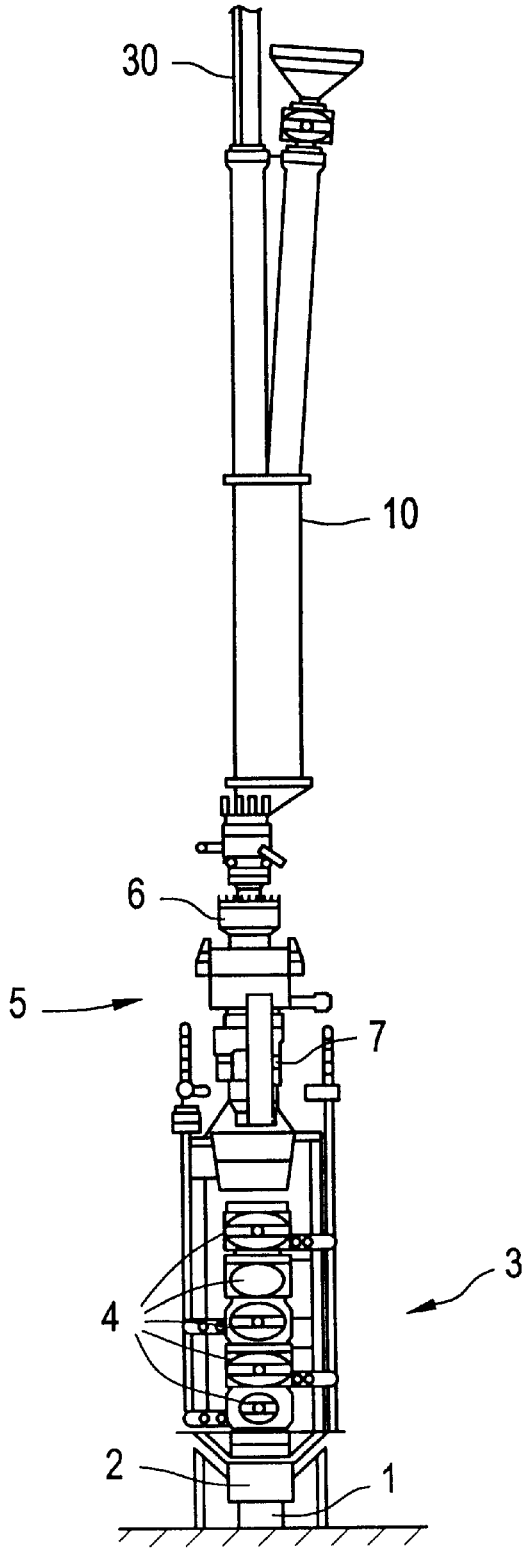
FIG. 1 is a side elevation of a riser connector according to the present invention in place on a wellhead assembly of conventional design on the sea floor.

Referring to FIG. 1, there is shown a BOP and wellhead assembly of conventional design in place on the sea floor. The assembly comprises a wellhead 1 extending up from the sea floor, to which is connected a wellhead connector 2. A lower stack, generally indicated as 3, comprising blowout preventers (BOP's) 4, as well as typical pressure control equipment and connectors. A lower main riser package (LMRP), generally indicated as 5, is situated above the lower stack 3. The LMRP comprises a flexible joint 6. The LMRP is connected to the lower stack 3 by means of a LMRP connector 7. A riser connector 10 according to the present invention is mounted on the flexible joint 6 of the LMRP 5. The BOP and wellhead assembly are of conventional design, well known to the person skilled in the art, and comprise a bore of conventional inner diameter, nominally 18.75 inches, through which access may be gained to the bore of the well below (not shown).

Figure 2:
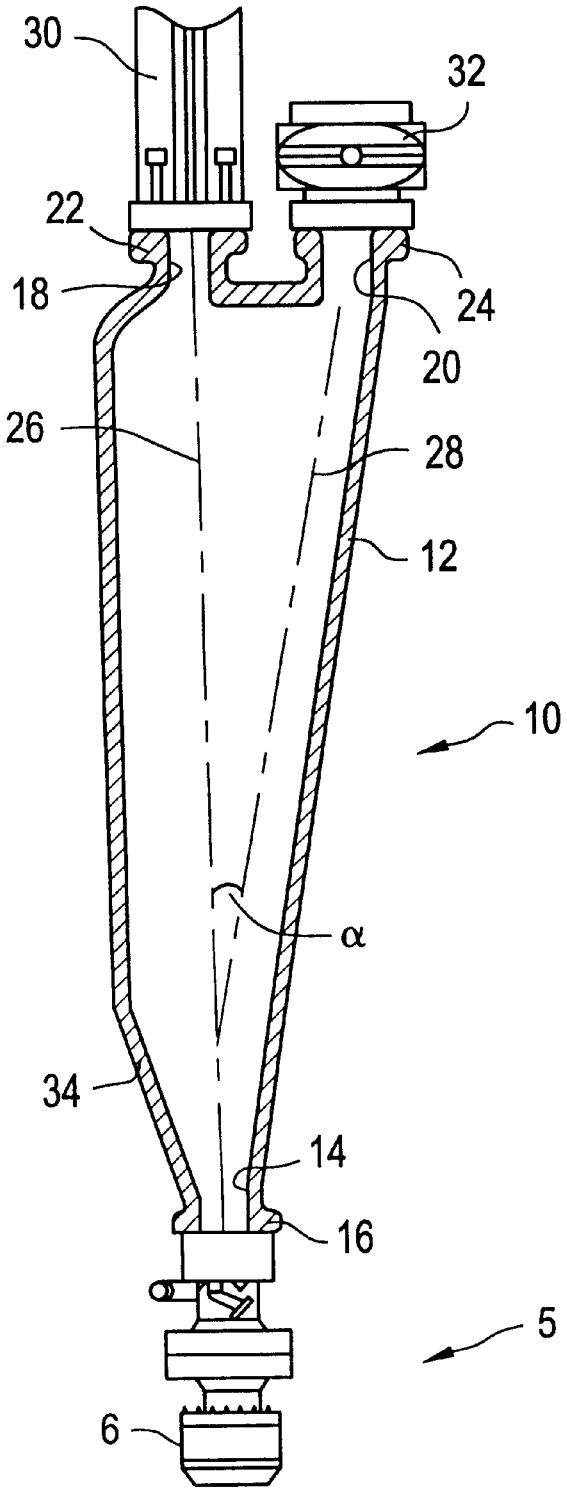
FIG. 2 is a partial cross-sectional side elevation of a first embodiment of the riser connector of the present invention in place on a subsea BOP and wellhead assembly.

A riser connector according to the present invention and generally indicated as 10 is shown in more detail in FIG. 2. The riser connector 10 comprises a housing 12 having an opening 14 in its first end, around which extends a flange 16, by which the riser connector 10 is bolted to the top flange of the LMRP 5. The diameter of the opening 14 in the first end of the housing 12 has a nominal diameter of at least the diameter of the bore through the BOP and wellhead assembly, and is typically at least 19 inches. In this way, all the tools and equipment required to be passed through the BOP and wellhead assembly during well operations may pass through the opening 14 in the first end of the housing 12 of the riser connector 10. The riser connector 10 comprises two adjacent openings, first and second openings 18 and 20, in the second end of the housing 12 opposing the opening 14 in the first end of the housing 12. Flanges 22 and 24 extend around the first and second openings 18 and 20 respectively.

The housing 12 of the riser connector 10 is of a generally tapered tubular form, the housing 12 diverging in the direction moving from the first end of the housing 12 adjacent the LMRP 5 towards the second end of the housing 12. Two conduits are formed within the housing 12, each occupying a portion of the volume contained within the housing 12. A first conduit, having its center line indicated as 26, extends from the first opening 18 in the second end of the housing 12 to the opening 14 in the first end of the housing 12. A second conduit, having its center line indicated as 28, extends from the second opening 20 in the second end of the housing 12 to the opening 14 in the first end of the housing 12. The second conduit is angled to the first conduit by an angle $\alpha$. The riser connector 10 is shown in FIG. 2 to be oriented such that the center line 26 of the first conduit is substantially vertically above the center of the central bore in the BOP and wellhead assembly. This orientation of the riser connector 10 is that in which well operations will normally take place. In this orientation, the center line 28 of the second conduit will lie at the angle $\alpha$ to the center of the central bore of the BOP and wellhead assembly.

A riser, generally indicated as 30, is bolted to the flange 22 around the opening 18 in the second end of the housing 12. The riser 30 is a small bore riser, having a nominal inner diameter of 14 inches. In the position shown in FIG. 2, the riser 30 is situated vertically above the BOP and wellhead assembly. All well operations that may be conducted through a small bore riser and accommodated by the inner diameter of 14 inches are carried out through the riser with the riser connector 10 in the position shown in FIG. 2.

A conventional ball valve 32 is bolted to the flange 24 around the second opening 20 in the second end of the housing 12. As an alternative to a ball valve, any other suitable form of valve may be employed. As a further alternative, a blowout preventer may be employed to close the second opening in the second end of the housing and isolate the interior of the housing from the seawater.

A portion of the housing 12 adjacent the first end of the housing 12 and lying at the intersection of the center line 28 of the second conduit with the housing 12 is shaped to form a guide 34. The guide 34 serves to guide tools and equipment being passed through the housing 12 through the opening 14 in the first end of the housing 12.

In normal use, first well operations are conducted through the small bore riser 30. The tools and equipment are passed down the riser 30 from the surface vessel or platform, through the first opening 18 in the second end of the housing 12, and into the first conduit within the housing. The tools and equipment pass along the center line 26 of the first conduit, through the opening 14 in the first end of the housing and into the BOP and wellhead assembly 2 and into the well bore. Such operations include setting casings in the well bore, such tubulars having an external diameter less than the internal diameter of the riser. Generally, such operations will be conducted with the riser connector 10 in the orientation shown in FIG. 2, that is with the riser 30 and the first conduit arranged to be substantially vertically above the center of the central bore of the BOP and wellhead assembly. In this way, the tools and equipment being passed through the riser connector 10 into the BOP and wellhead assembly and the well bore are required to overcome the minimum of deviation in direction. The housing 12 acts as guide to provide the guidance necessary to allow the tools and equipment to pass through the opening 14 in the first end of the housing and into the BOP and wellhead assembly. While the first well operations are in progress, the valve 32 is maintained in the closed position, thus closing the second opening 20 in the second end of the housing 12 and sealing the interior of the housing 12 from sea water.

When it is required to carry out second well operations that cannot be conducted through the small bore riser 30, an alternative approach is taken. Operations through the small bore riser 30 are ceased and those well tools and tubulars removed. The larger tools and equipment necessary for conducting the second well operations are passed through the open water and staged at or near the upper flange of the valve 32. The valve 32 is opened and the tools and equipment pass through the second opening 20 in the second end of the housing 12 and into the second conduit therein. The tools and equipment follow the center line 28 until they reach the guide 34, by which they are guided through the opening 14 in the first end of the housing 12.

The housing 12 is sized in length such that the angle between the first and second conduits (as represented by the angle α between the center lines 26 and 28 in FIG. 2) is sufficiently acute that the necessary deviation can be negotiated by the tools and equipment during the second well operations. It will be appreciated that by lengthening the housing 12, the angle α will decrease, allowing the tools and equipment passing though the second conduit to have an easier passage through the connector 10 and into the BOP and wellhead assembly. This will increase the overall weight and construction costs of the riser connector 10. Conversely, the weight and overall construction costs of the connector 10 may be reduced by decreasing the length of the housing 12. This in turn will increase the angle α, increasing the difficulty of maneuvering the tools and equipment through the housing 12 and into the BOP and wellhead assembly. Preferably, the angle α between the first and second conduits is from 2 to 20 degrees, preferably 3 to 15 degrees. A typical operating angle will be approximately 10 degrees.

Figure 3:
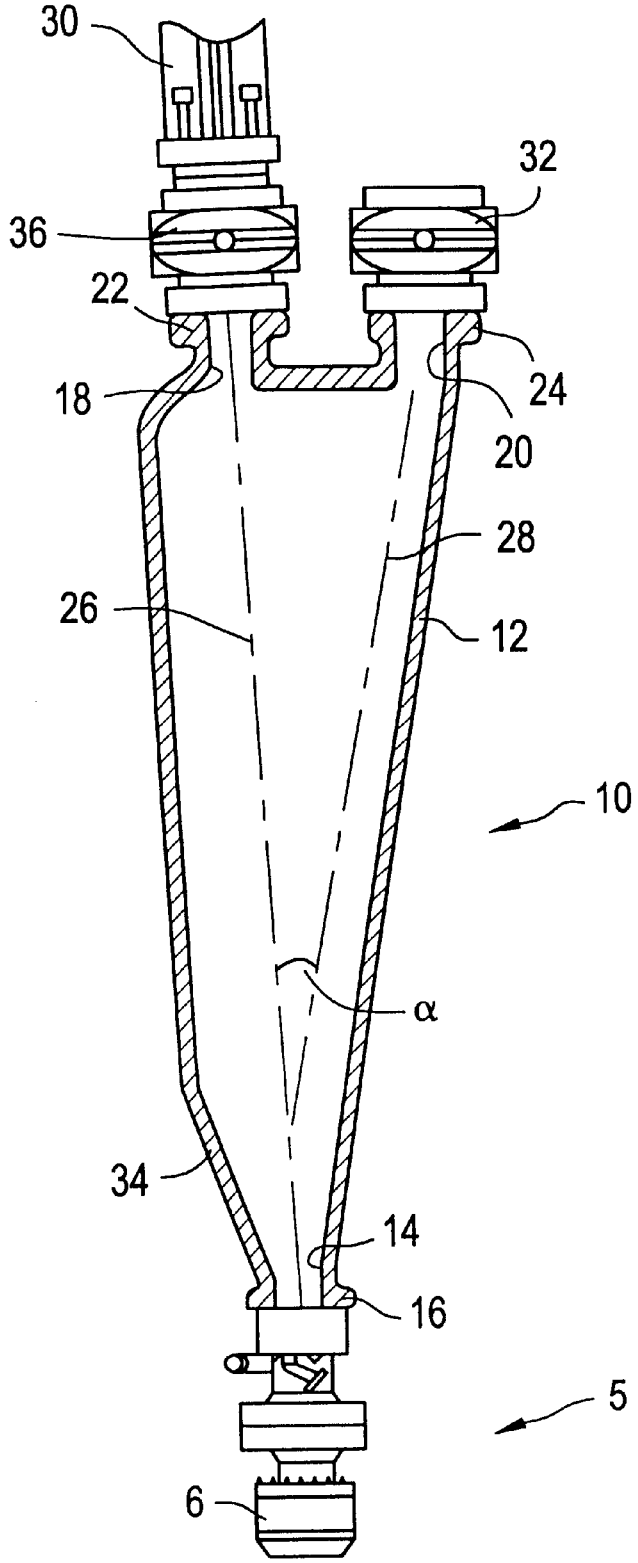
FIG. 3 is a partial cross-sectional side elevation of a modification of the arrangement of FIG. 2.

With the embodiment of the riser connector of the present invention shown in FIG. 2, the riser 30 remains open to the interior of the housing 12 during the second well operations. In this way, the riser 30 may be used as a supply or return for drilling fluids or muds required during the second well operations. FIG. 3 shows a modification to the arrangement shown in the FIG. 2. In particular, the embodiment of FIG. 3 comprises an additional valve 36, for example a ball valve, located between the lower end of the riser 30 and the first opening 18 in the second end of the housing. The valve 36 may be used to isolate the riser 30 from the riser connector 10 and the BOP and wellhead assembly, while the second well operations are in progress. In this way, the potential loss of drilling fluids or muds in the riser 30 to the seawater may be prevented. The valve 36 may also be used to isolate the interior of the riser connector from seawater when it is desired to pull the riser.

Figure 4:
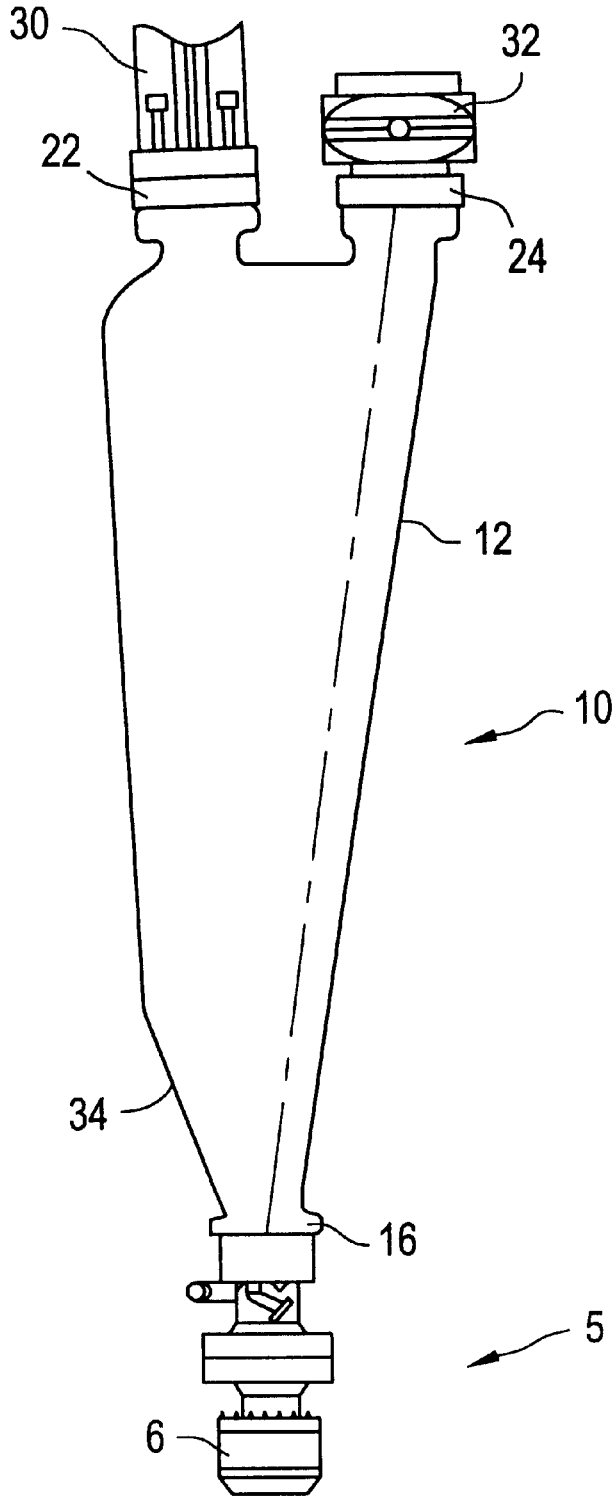
FIG. 4 is a side elevation of the riser connector and wellhead assembly of FIG. 2 in a second operating position.

An alternative method of operation of the riser connector of FIG. 2 is shown in FIG. 4. As described above, the arrangement shown in FIG. 2 is maintained in the position shown, that is with the central longitudinal axis of the small bore riser 30 and the central line 26 of the first conduit maintained substantially vertically above the central bore of the BOP and wellhead assembly and the well bore. As described above, this position is maintained throughout the duration of both the first and second well operations. The alternative shown in FIG. 4 makes use of the flexible joint 6 in the LMRP 5 in the BOP and wellhead assembly. When it is required to carry out second well operations through the second opening 20 and the second conduit, the riser connector 10, together with that portion of the LMRP 5 above the flexible connector 6 is tilted to orient the second opening 20 in the second end of the housing 12 and the center line of the second conduit 28 to be more vertically arranged above the center line of the central bore of the wellhead assembly 2. To achieve this, the riser 30 must be moved to one side, for example by maneuvering the vessel or platform at the surface. In this alternative method, the task of introducing large diameter tools and equipment, including drilling bits and large diameter casings, through the riser connector 10 and into the BOP and wellhead assembly may be eased. In addition, this method allows the floating vessel or platform carrying out the second well operations to be sited vertically over the well bore.

Figure 5:
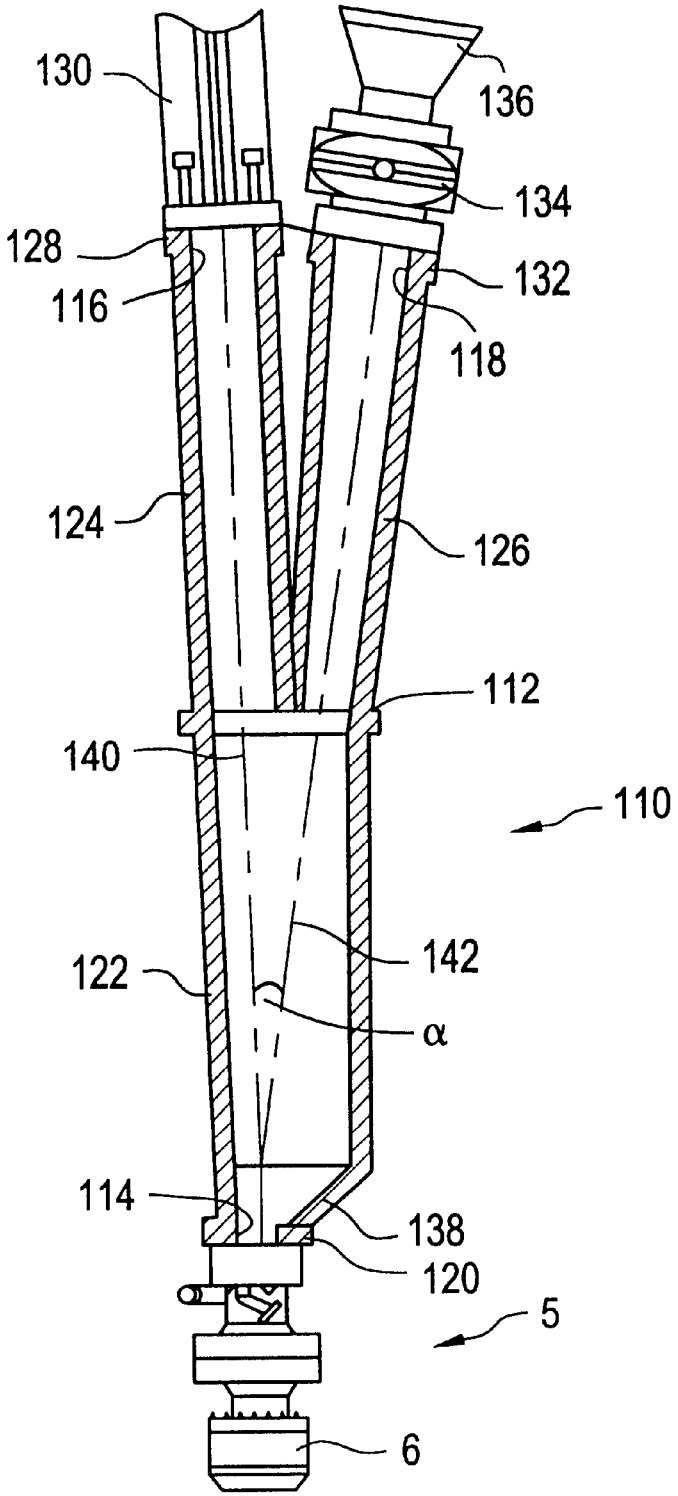
FIG. 5 is a partial cross-sectional elevation of a second embodiment of the riser connector of the present invention in place on a subsea wellhead assembly.

Reference is now made to FIG. 5. This figure shows a second embodiment of the riser connector of the present invention in place on a LMRP of a BOP and wellhead assembly on the sea bed. The LMRP, generally indicated as 5, comprises a flexible joint 6, of conventional design.

A riser connector according to the present invention, generally indicated as 110, is situated on the top of the LMRP 5. The riser connector 110 comprises a housing 112 having an opening 114 in its first end adjacent the LMRP 5 and first and second openings 116 and 118 in its second end distanced from the LMRP 5. A flange 120 extends around the opening 114 in the first end of the housing 112, by which the riser connector 110 is bolted to the uppermost flange of the LMRP 5.

The housing 112 comprises lower housing portion 122, having a generally cylindrical shape. The riser connector 110 is mounted to the top of the LMRP 5 with the center line of the lower housing portion 122 offset from the center line of the bore in the BOP and wellhead assembly. The housing 112 further comprises a first upper housing portion 124 and a second upper housing portion 126 extending from the diverged end of the lower housing portion 122. The first upper housing portion 124 is in the form of a tube, the open end of which forms the first opening 116 in the second end of the housing 112. Similarly, the second upper housing portion 126 is in the form of a tube, the open end of which forms the second opening 118 in the second end of the housing 112.

A flange 128 extends around the first opening 116, to which is bolted a small bore riser 130. A flange 132 extends around the second opening 118, to which is bolted a valve 134, for example a ball valve. A guide 136, in the form of an open, inverted cone, is bolted to the free flange of the valve 134.

A portion of the lower housing 122 is angled inwards towards the opening 114 in the first end of the housing 112 and provides a guide 138 for tools and equipment passing through either the first or second conduits to pass into the central bore of the BOP and wellhead assembly.

A first conduit having a center line 140 indicated in FIG. 5 is formed by the first upper housing portion 124 and extends from the first opening 116 in the second end of the housing 112 through the lower housing portion 122 to the opening 114 in the first end of the housing 112. A second conduit having a center line 142 indicated in FIG. 5 is formed by the second upper housing portion 126 and extends from the second opening 118 in the second end of the housing 112 through the lower housing portion 122 to the opening 114 in the first end of the housing 112. The second upper housing portion 126 is angled with respect to the first upper housing portion 124 and the lower housing portion 122, such that the center line 142 of the second conduit subtends an angle α with the center line 140 of the first conduit. The riser connector 110 is oriented as shown in FIG. 5, such that the center line 140 of the first conduit is substantially vertically above the center line of the central bore of the BOP and wellhead assembly.

In use, first well operations are conducted through the small bore riser 130, with the tools and equipment gaining access to the BOP and wellhead assembly and the bore of the well through the first conduit. When it is desired to conduct second well operations requiring the use of tools and equipment having a diameter too large to be accommodated by the small bore riser, access is gained to the BOP and wellhead assembly and the well bore through the second conduit. The operation follows the general procedure outlined above in connection with the embodiment shown in FIGS. 2 to 4. As before, the second well operations are conducted through the open water to reach the second opening 118 in the housing 112. The guide 136 is provided to assist the tools and equipment passed through the open water to enter the second opening 118 through the valve 134.

The angle α will depend upon the length of the housing 112, in particular the length of the lower housing portion 122. The criteria for the sizing of the housing 112 and the angle α are as discussed above.

Figure 6:
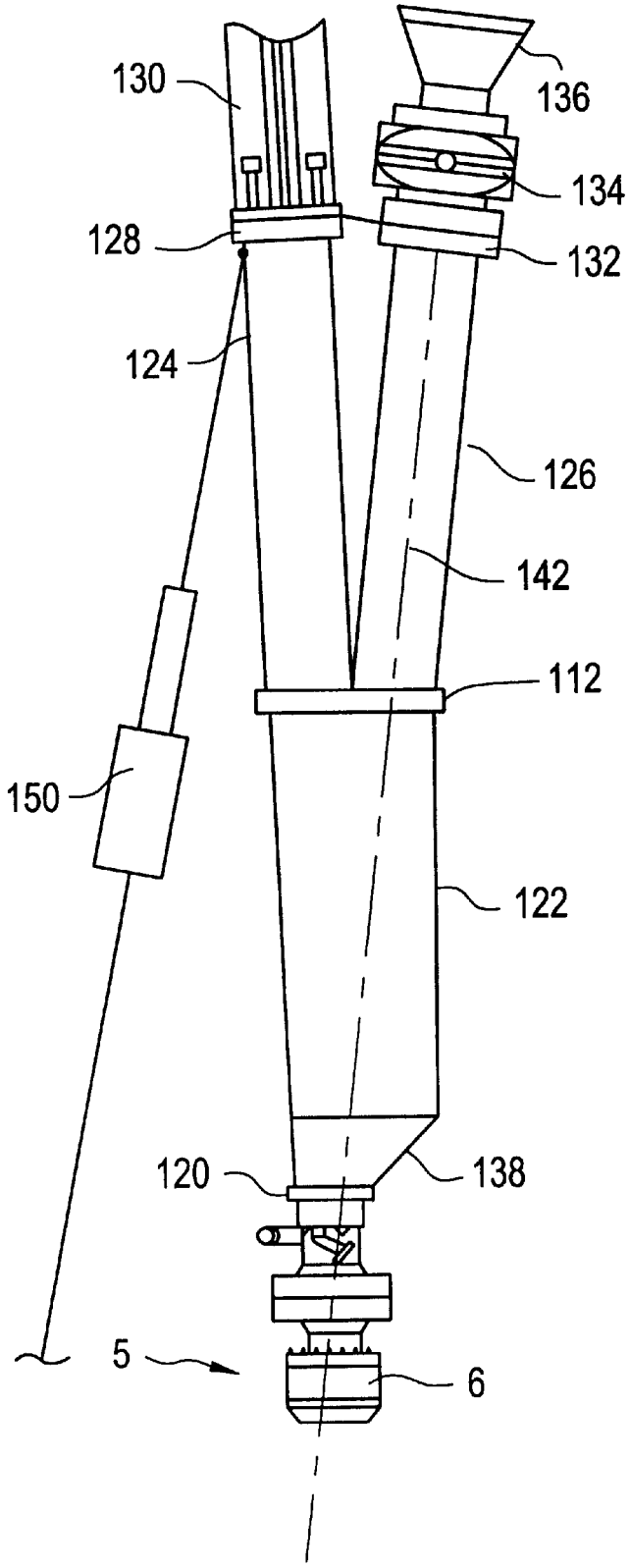
FIG. 6 is a side elevation of the riser connector and wellhead assembly of FIG. 4 in a second operating position.

All well operations may be conducted with the riser connector 110 in the position shown in FIG. 5. Alternatively, the riser connector 110 may be tilted, as shown in FIG. 6, so as to position the second opening 118 vertically above the central bore of the BOP and wellhead assembly. The riser connector may be tilted to the position shown in FIG. 6 by taking advantage of the flexible joint 6 in the LMRP 5 and moving the riser 130. This requires the vessel or floating platform on the surface to be maneuvered accordingly.

Alternatively, the riser connector 110 may be provided with an actuator 150, shown in FIG. 6, to move the entire assembly above the flexible connector 6 between the first position shown in FIG. 5 to that shown in FIG. 6. The actuator 150 is shown in FIG. 6 as being attached at one end, for example by means of a cable, to the exterior of the housing 112 of the riser connector 110 adjacent the flange 128. The other end of the actuator is anchored to a fixed structure, for example part of the BOP and wellhead assembly of the same or a closely neighbouring well. Alternatively, the actuator 150 may be anchored to the drilling template, if one is being employed. As a further alternative, a dedicated anchor may be provided to secure the actuator 150 to the sea floor. Actuators suitable for use in moving the riser connector 110 of the present invention are known in the art and understood by the person skilled in the art.

In general, in addition to making use of the flexible joint 6, of the LMRP 5 to move the orientation of the riser connector 10, 110, a portion or the whole of the housing 12, 112 may be prepared with sufficient flexibility to allow the first and second openings 18, 116 and 20, 118 to be moved into position vertically above the central bore of the BOP and wellhead assembly, 102 and the bore of the well. In some cases, the housing 12, 112 of the riser connector 10, 110 could be made sufficiently flexible that it will be possible to dispense with the flexible joint 6, 106 in the BOP stack, if so desired.

Figure 7:
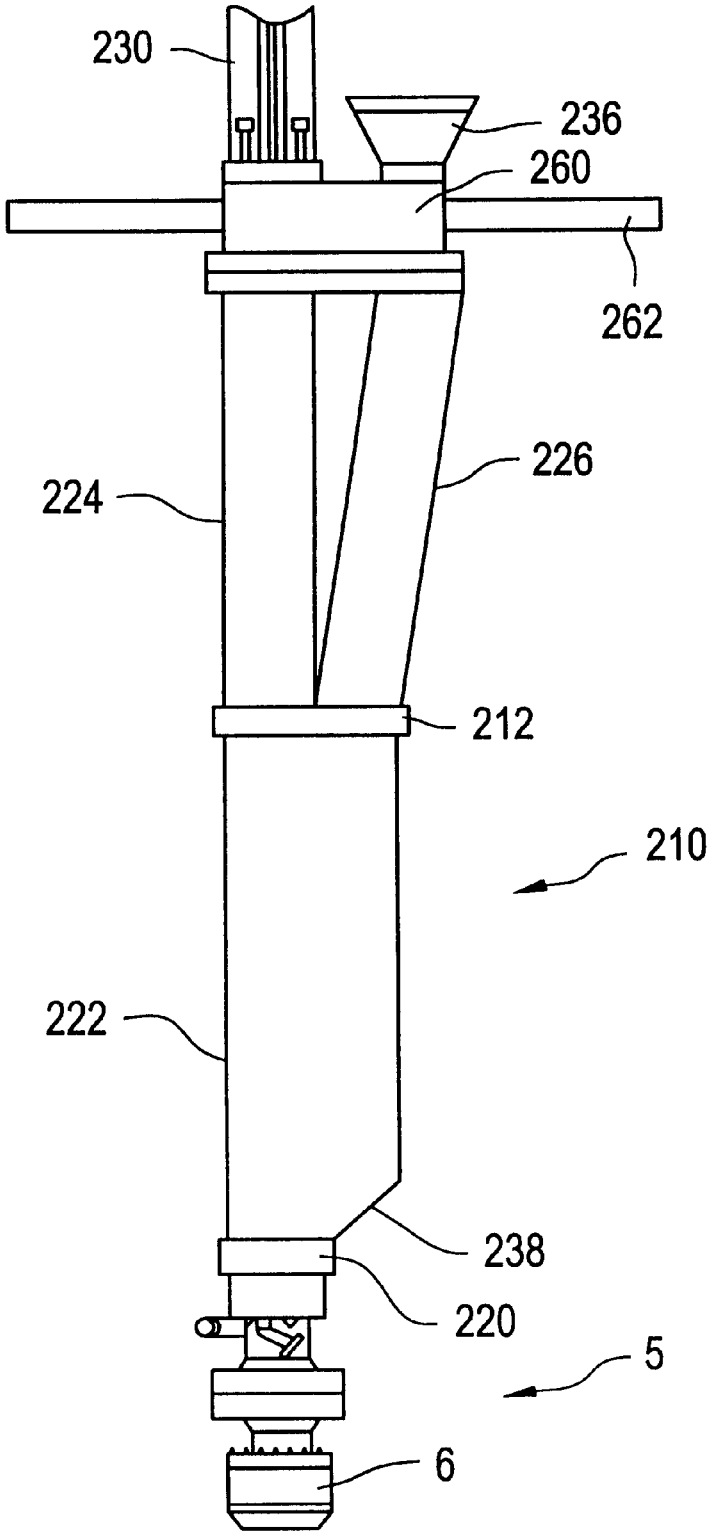
FIG. 7 is a cross-sectional side elevation of a further embodiment of the riser connector of the present invention.

As noted above, it is generally most preferable to have a valve 32, 134 to close to the second opening 20, 118 in the second end of the housing 12, 112, in order to isolate the second conduit and the interior of the housing 12, 112 from the seawater. As shown in FIG. 3, a second valve 36 positioned to close the first opening 18, 116 and isolate the riser 30, 130 from the first conduit and the interior of the housing 12, 112 is also advantageous. A similar valve could be installed between the riser 130 and the flange 128 in the embodiment shown in FIGS. 5 and 6 to achieve the same purpose. FIG. 7 shows and embodiment of the present invention, in which a single valve assembly is employed to open and close the first and second openings in the second end of the housing.

Referring to FIG. 7, a riser connector 210 of the general design shown in FIGS. 5 and 6 is in position on a LMRP 5. Features of the assembly of FIG. 7 common to the assembly of FIGS. 5 and 6 have the same reference numerals, with 2 as the prefix. The riser connector 210 of FIG. 7 comprises a single gate valve 260 extending across both the first and second openings in the second end of the housing 212. A sliding gate 262 is movable within the valve 260 and comprises a plurality of holes. The sliding gate 262 may be positioned so as to close one or both of the first and second openings in the second end of the housing 212 as desired, according to the needs of the particular operation being conducted. In this way, the second opening in the second end of the housing 212 may be opened at the same time as closing the first opening, if required. Alternatively, both openings may be opened or closed, as required.

Figure 8:
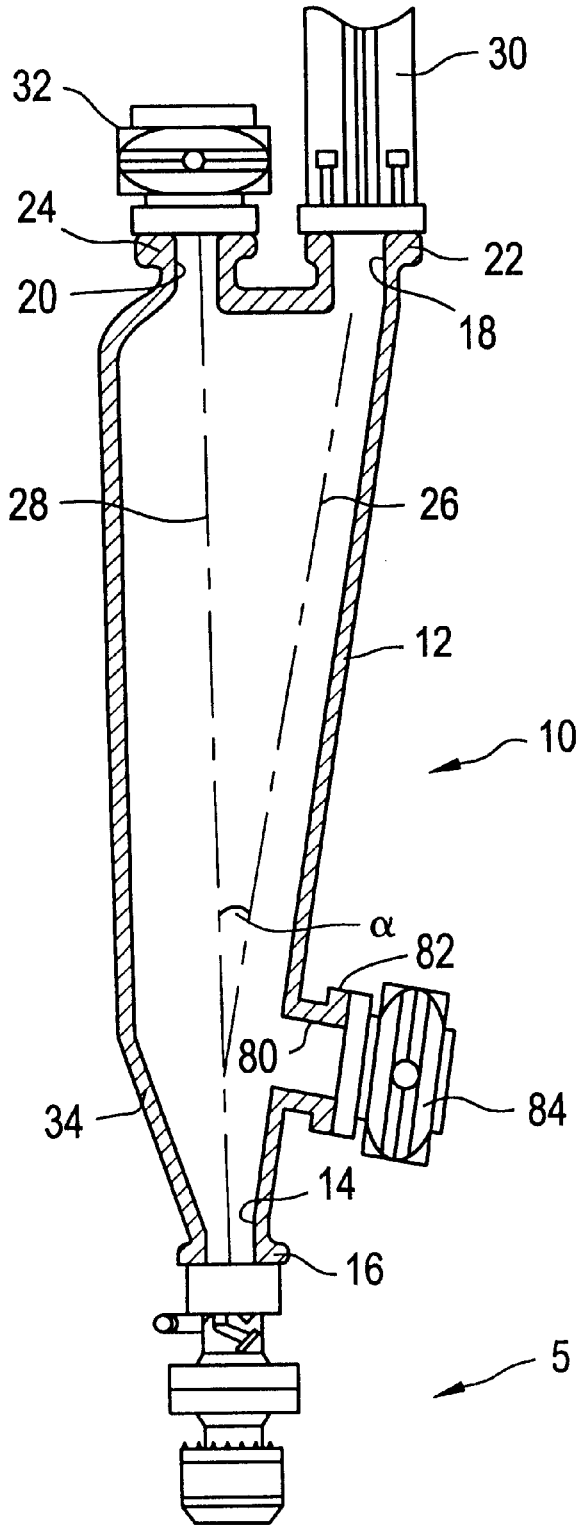
FIG. 8 is a cross-sectional side elevation of an alternative arrangement of the embodiment of the riser connector of FIG. 2.

As noted above, it is often easier for smaller diameter tools and equipment to negotiate deviations in the path to be followed when being run into the well, than it is for larger sized equipment. Accordingly, when using a small bore riser, it may be preferred to arrange the riser connector such that the second conduit, to be followed by tools and equipment run into the well using open water techniques, is oriented directly above the bore in the BOP and wellhead assembly. The first conduit, connecting the small bore riser to the BOP and wellhead assembly, will then lie at an angle to the bore of the BOP and wellhead assembly. Reference in this respect is made to FIG. 8, in which a riser connector 10 is shown having substantially the same features and design as the riser connector of FIG. 2. Components common to the connectors of FIGS. 1 and 8 are indicated using the same reference numerals. In the riser connector 10 of FIG. 8, the positions of the first and second openings 18, 20 in the second end of the housing 12 have been reversed. In this arrangement, the center line 28 of the second conduit is coincident with the center line of the bore of BOP and wellhead assembly. In this way, large diameter tools and tubulars being run into the well through the open water have no significant deviation to negotiate. The center line 26 of the first conduit is at an angle α to the center line 28 of the second conduit. The smaller diameter tools and equipment being run into the BOP and wellhead assembly through the riser 30 will thus be required to negotiate this deviation.

Further, as also noted above, it may be advantageous to provide a further opening in the housing of the riser connector, for example to allow the riser to be evacuated. Again with reference to FIG. 8, the riser connector 10 comprises an opening 80 in the side of the housing 12 adjacent the first end of the connector. A flange 82 extends around the opening 80, to which is mounted a valve 84.

Figure 9:
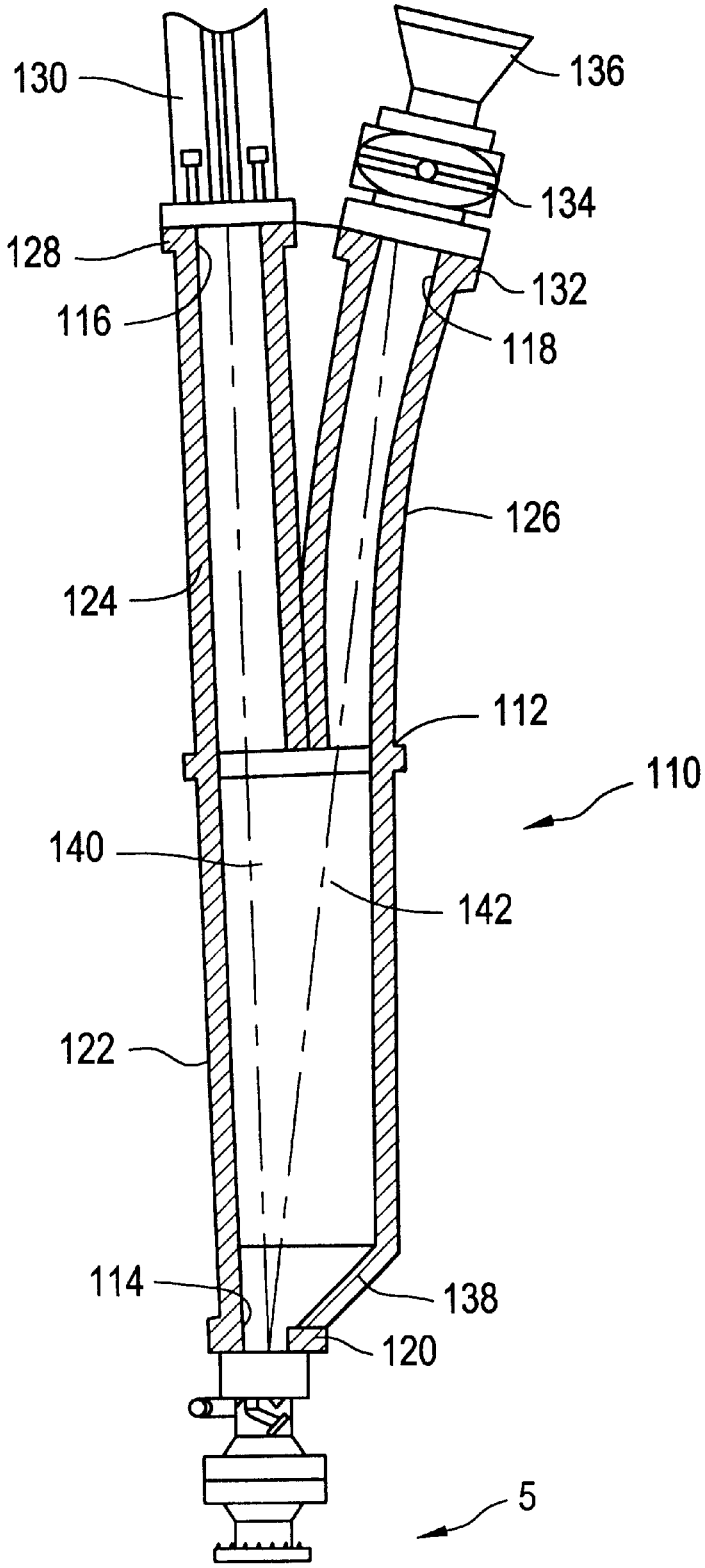
FIG. 9 is a cross-sectional side elevation of an alternative arrangement of the embodiment of the riser connector of FIG. 5.

As a further manner in which the riser connector can be arranged to assist guiding the tools and equipment being run into the well through the open water, the second conduit may be formed so as to have a central axis which is at least partially curved. Reference in this respect is made to FIG. 9, in which a riser connector 110 having substantially the same components and features as the riser connector of FIG. 5 is shown. Components and features common to the connectors of FIGS. 5 and 9 are indicated using the same reference numerals. The riser connector 110 of FIG. 9 comprises a second upper housing portion 126, in the form of a curved tube. The second conduit defined by the second upper housing portion 126 thus has a curved longitudinal axis, to aid in guiding tools and equipment into the BOP and wellhead assembly.

It should be noted that the riser connector of the present invention does not require the riser to be disconnected from the connector and the BOP and wellhead assembly. If a valve is employed to close the first opening in the second end of the housing and isolate the first conduit and the interior of the housing from the riser, it is not necessary to empty the riser before continuing with the open water operations or to adjust the mud weight within the riser, as is required with some set aside systems of the prior art.

Further, it will be appreciated that removing the need to disconnect the riser allows the control lines and choke and kill lines to remain connected and operational. Such lines are required to span the length of the riser connector between the end of the riser and the BOP and wellhead assembly, but have been omitted from the figures for clarity.

It will be appreciated that the riser connector of the present invention allows a small bore riser to be employed for all downhole operations which may be accommodated by such a riser. This leads to a significant saving in terms of the weight of the riser and the volume and weight of drilling fluids and mud required to operate through the riser. When it is required to install a large diameter casing in the well bore, access can be gained to the BOP and wellhead assembly and the bore of the well through the second conduit in the riser connector, access to which is gained through the second opening in the second end of the housing. It will be appreciated that this allows the casing to be run into the wellhead through the open water and be provided through an opening in the assembly above the flexible joint in the BOP stack present in most conventional wellhead assemblies.

Further, the riser connector of the present invention allows tools and tubulars to be prestaged in the open water alongside the riser, while normal well operations, such as drilling, are being carried out through the riser, be it a conventional bore or a small bore riser. At the appropriate time, the well operations being conducted through the riser are ceased and the entire open water assembly of tools or well tubulars can be very quickly installed into the BOP and wellhead assembly. In this way, prestaging does not have to wait until well operations have ceased. This facility allows non-productive operating time to be reduced. This is of particular advantage in the case of deep water drilling operations, in which the non-productive operating time required for the staging of tools and tubulars can be a significant portion of the overall time taken to drill and complete a well.

While the preferred embodiments of the present invention have been shown in the accompanying figures and described above, it is not intended that these be taken to limit the scope of the present invention and modifications thereof can be made by one skilled in the art without departing from the spirit of the present invention.

What we claim is:

1. A riser connector for connecting a riser to a wellhead assembly having a bore therethrough, the connector comprising:

a housing having a first and a second end;

the first end of the housing having an opening of a diameter at least substantially the same as the inner diameter of the bore of the wellhead assembly and being adapted for connecting to the wellhead assembly with the opening in communication with the bore of the wellhead assembly;

the second end comprising a first opening connectable to the riser and having a diameter at least substantially the same as the inner diameter of the riser, and a second opening, having a diameter at least substantially the same as the diameter of the bore of the wellhead assembly;

the housing further comprising a first conduit connecting the opening in the first end of the housing to the first opening in the second end of the housing, and a second conduit connecting the opening in the first end of the housing to the second opening in the second end of the housing; and, the connector is flexible whereby in use the orientation of the first and second conduits with respect to the wellhead assembly can be varied.

2. The riser connector as claimed in claim 1, further comprising an actuator for varying the orientation of the first and second conduits when the connector is in use.

3. The riser connector as claimed in claim 1, further comprising a valve for closing the first conduit.

4. The riser connector as claimed in claim 1, further comprising a valve for closing the second conduit.

5. The riser connector as claimed in claim 1, further comprising a valve for closing the first conduit, the second conduit or both conduits.

6. The riser connector as claimed in claim 1, wherein the first end of the housing is adapted to be mounted directly to the wellhead assembly.

7. A wellhead assembly, comprising:

a central bore through the wellhead assembly;

a riser connector, the riser connector comprising:

a housing having a first and a second end;

the first end of the housing being connected to the wellhead assembly and having an opening in communication with the bore of the wellhead assembly, the opening having a diameter at least substantially the same as the bore of the wellhead assembly;

the second end comprising a first opening connectable to a riser and having a diameter at least the same as the inner diameter of the riser, and a second opening, having a diameter at least substantially the same as the diameter of the bore of the wellhead assembly;

the housing further comprising a first conduit connecting the opening in the first end of the housing to the first opening in the second end of the housing, and a second conduit connecting the opening in the first end of the housing to the second opening in the second end of the housing; and, the wellhead assembly further comprising a flexible joint, the flexible joint being disposed so as to lie between a riser connected to the wellhead assembly and a well below the wellhead assembly when in use.

8. The wellhead assembly as claimed in claim 7, wherein the riser connector is the flexible joint.

9. The wellhead assembly as claimed in claim 7, further comprising an actuator for varying the orientation of the first and second conduits when the assembly is in use.

10. The wellhead assembly as claimed in claim 9, wherein the connector is biased to the position in which the longitudinal axis of the first conduit is substantially coincident with the central longitudinal axis of the wellhead assembly.

11. The wellhead assembly as claimed in claim 7, further comprising a valve for closing the first conduit.

12. The wellhead assembly as claimed in claim 7, further comprising a valve for closing the second conduit.

13. The wellhead assembly as claimed in claim 7, further comprising a valve for closing the first conduit, the second conduit or both conduits.

14. The wellhead assembly as claimed in claim 7, further comprising a riser connected to the first opening in the second end of the housing of the connector.

15. A method of conducting well operations on an offshore well having a wellhead assembly, the wellhead assembly having a bore therethrough, the method comprising:

providing a first conduit having an upper end and a lower end, the lower end being in communication with the bore of the wellhead assembly;

connecting a riser to the upper end of the first conduit;

providing a second conduit having an upper end and a lower end, the lower end being in communication with the bore of the wellhead assembly, the upper end being accessible through the open water;

conducting first well operations accommodated by the inner diameter of the riser through the riser and first conduit;

conducting second well operations through the open water and the second conduit; and, wherein a flexible joint is provided, the upper end of the second conduit being above the flexible joint.

16. The method of claim 15, wherein the riser remains connected to the first conduit and operable during the second well operations.

17. The method of claim 15, wherein the second well operations comprise installing apparatus with an outer diameter greater than the inner diameter of the riser.

18. The method of claim 17, wherein the apparatus is run and guided in the open water alongside the riser while the first well operations are in progress.

19. The method of claim 17, wherein the first conduit is closed during the second well operations.

20. The method of claim 17, wherein the first conduit remains open during the second well operations.

21. The method of claim 15, wherein fluid is supplied or returned through the riser and the first conduit while the second well operations are in progress.

22. The method of claim 17, wherein the riser has an internal diameter less than the diameter of the bore kof tkhe wellhead assembly.

* * * * *